US006328392B1

(12) United States Patent
Whitcomb

(10) Patent No.: US 6,328,392 B1
(45) Date of Patent: Dec. 11, 2001

(54) FOOT PEDAL DOOR OPENER DEVICE FOR A REACH-IN CABINET AND METHOD OF MOUNTING SAME

(75) Inventor: Dirk Travis Whitcomb, Stockbridge, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 09/460,417

(22) Filed: Dec. 14, 1999

(51) Int. Cl.[7] ..... A47B 88/00

(52) U.S. Cl. ..... 312/319.9; 312/319.1; 49/274

(58) Field of Search ..... 312/319.1, 319.9, 312/324, 326, 329, 139; 49/263, 270, 273, 274

(56) References Cited

U.S. PATENT DOCUMENTS

| | | | | |
|---|---|---|---|---|
| 921,020 | * | 5/1909 | Spencer | 312/329 X |
| 1,174,136 | * | 3/1916 | Filger | 49/274 |
| 1,244,910 | * | 10/1917 | Smith | 49/272 X |
| 1,671,222 | * | 5/1928 | Brady | 49/274 |
| 1,882,536 | | 10/1932 | Weinheimer . | |
| 2,021,914 | | 11/1935 | Goulooze . | |
| 2,124,349 | * | 7/1938 | Herbster | 312/319.9 X |
| 2,689,776 | * | 9/1954 | Cline | 312/319.9 |
| 2,904,823 | | 9/1959 | Perrill . | |
| 3,012,837 | | 12/1961 | Morrissey, Jr. . | |
| 3,364,621 | * | 1/1968 | Erickson | 312/319.9 X |
| 4,911,508 | | 3/1990 | Tillman . | |
| 5,193,863 | | 3/1993 | McBain . | |
| 5,540,012 | * | 7/1996 | Clegg | 312/321.5 X |
| 5,622,416 | | 4/1997 | Rainey et al. . | |
| 5,975,662 | * | 11/1999 | Weber | 312/319.9 |

* cited by examiner

*Primary Examiner*—Peter M. Cuomo
*Assistant Examiner*—Hanh V. Tran
(74) *Attorney, Agent, or Firm*—Arent Fox Kintner Plotkin & Kahn, PLLC

(57) ABSTRACT

A foot pedal door opener device for use with a reach-in commercial cabinet, having a mounting bracket and retaining clip that allow the foot pedal to be mounted in a desired position for a left or right side opening door. The mounting bracket has at least two holes in a top portion of the bracket body to retrofit or mount the bracket to an outer surface of the cabinet. The retaining clip is configured to be aligned with either one of the holes of the bracket body. A connector passes through the retaining clip and corresponding hole of the bracket and penetrates the outer surface of the cabinet to secure the retaining clip to the bracket body and the mounting bracket to the cabinet. The pedal engages a rotating member that connects the pedal to the mounting bracket such that when a user depresses the pedal, the pedal rotates toward the user around the rotating member, whereby an engaging head of the pedal pushes the cabinet door open.

18 Claims, 11 Drawing Sheets

FOOT PEDAL DOOR OPENER DEVICE FOR A REACH-IN CABINET AND METHOD OF MOUNTING SAME

BACKGROUND OF INVENTION

1. Field of the Invention

The invention is directed to a foot pedal door opener device for a reach-in cabinet having a door hinged on a first side of the housing opposite the opener and open on a second side of the housing having the door opener, thereby swinging outward. The foot pedal door opener device allows a user to open the door while their hands are full, and thereby enter and access the interior of the cabinet with a minimum of effort and inconvenience.

2. Description of Related Art

Foot pedal door opener devices for various types of cabinets, such as, for example, refrigerators, freezers, and the like are well known in the art. An example of a known pedal operated door opener device is shown in U.S. Pat. No. 3,012,837 to Morrissey, Jr., which uses a single foot pedal mounted within a compartment below the storage area and door of the cabinet. However, because the foot pedal is mounted within the compartment, an opening in a front region of the compartment is required so that the foot pedal may be placed within the compartment. As such, the foot pedal is difficult to retrofit to existing cabinets. Additionally, the space necessary to house the foot pedal may not be available in the existing cabinet. Furthermore, because the operating rod of the Morrissey door opener does not contact the door of the cabinet but rather pushes against a contact member attached to the bottom of the cabinet door, a significant amount of hardware and assembly is required, thereby increasing the time and cost associated with installing the door opener.

U.S. Pat. No. 2,904,823 to Perrill describes a cabinet door opening means that uses a pedal to open the cabinet door. The door opening means requires the construction of compartments that extend in a vertical direction of the cabinet to house the opening means, which increases manufacturing costs as well as compromises the integrity of the cabinet structure. When the pedal of the door opening means is depressed, a slide opening rod within the vertical compartment raises a slide which opens the cabinet door.

U.S. Pat. No. 4,911,508 to Tillman discloses a foot pedal operated door opener for a cabinet having a horizontal pivot rod requiring a mounting bracket for each end of the pivot rod that is mounted to the cabinet. A foot pedal at an end of the pivot rod is offset from the opening of the door. Therefore, the foot pedal of the opener must be actuated from behind the door, which requires a user to walk along the side of the cabinet and depress the pedal to open the door. The user must then walk around to the front of the cabinet to access the interior of the cabinet.

Also, U.S. Pat. No. 5,622,416 to Rainey et al. shows a foot pedal door opener device designed to be used with a two-door cabinet. In operation, the door opener device is used in a cross over fashion to open alternating doors. In other words, when the left pedal is actuated, the right cabinet door opens and when the right pedal is actuated, the left door opens. Further, the dual pedal nature of the door opener renders the device incompatible with cabinets having anything other than a two-door configuration.

SUMMARY OF THE INVENTION

The invention is directed to a foot pedal door opener device for use with a reach-in commercial cabinet such that a user can walk up to the front of the cabinet, depress the foot pedal and have the door open without the need for the user to move out of the way of the door or grab the handle. The configuration of the invention is accomplished with a simple, cost effective, and durable structure. The foot pedal door opener device of the invention includes a mounting bracket and retaining clip that allow the foot pedal to be mounted in a desired position for a left or right side opening door.

The mounting bracket has at least two holes in a top portion of the bracket body to retrofit or mount the bracket to an outer surface of the cabinet. The retaining clip has an oblong aperture in a vertical portion of the clip that is configured to be aligned with either one of the holes of the bracket body. A connector, such as, for example, a screw or the like, passes through the oblong aperture of the clip and the corresponding hole of the bracket body over which the clip is aligned and penetrates the outer surface of the cabinet to secure the retaining clip to the bracket body and the mounting bracket to the cabinet.

If the retaining clip is mounted to the left side of the mounting bracket, then the pedal is mounted to the right side of the mounting bracket to form a left side foot pedal door opener. Likewise, if the retaining clip is mounted to the right side of the mounting bracket, then the pedal is mounted to the left side of the mounting bracket to form a right side pedal door opener.

The pedal includes an inclined portion having a tread portion extending substantially horizontal from a bottom end of the inclined portion and an actuating portion extending substantially vertical from a top end of the inclined portion. The actuating portion includes an engaging head provided at a distal end of the actuating portion to contact and open the cabinet door. The inclined portion of the pedal has a pair of flanges engaged by a rotating member that connects the pedal to the mounting bracket such that when a user depresses the tread portion of the pedal, the pedal rotates toward the user around the rotating member, whereby the engaging head of the actuating portion of the pedal pushes the cabinet door open.

BRIEF DESCRIPTION OF THE DRAWINGS

Other objects and features of this invention will become understood from the following description, with reference to the accompanying drawings, wherein.

DETAILED DESCRIPTION OF THE PREFERRED EMBODIMENTS

Figure 1:
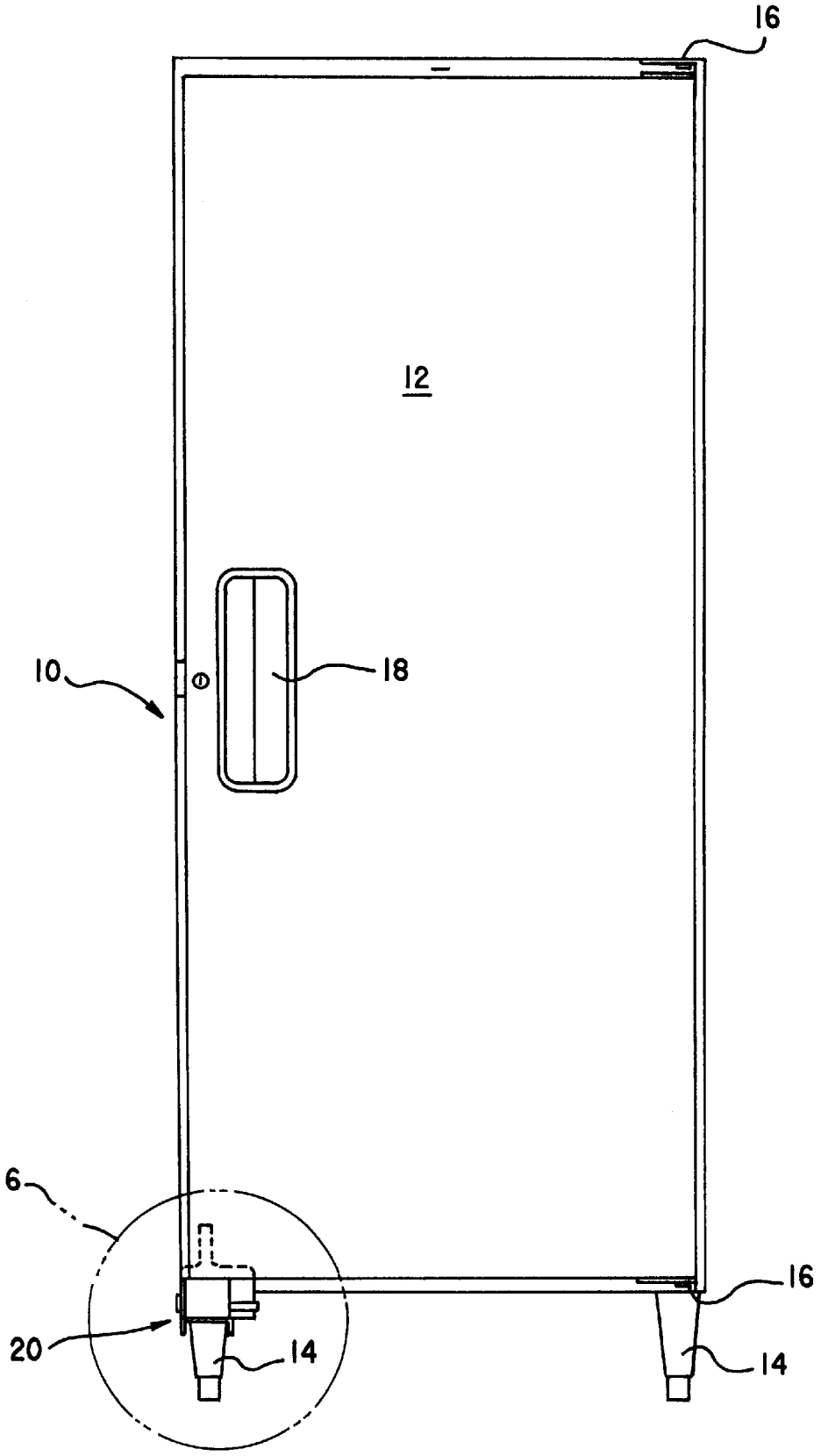
FIG. 1 a front view of a single door cabinet having a foot pedal door opener device according to a first embodiment of the invention.

FIG. 1 illustrates a front view of a single-door commercial reach-in type cabinet 10 with a right-handed door 12. The cabinet 10 can be supported by legs 14, or by casters (not shown). The right side of the door 12 is provided with hinges 16 at upper and lower portions thereof so that the door 12 can swing outwardly from the left or non-hinged side of the door 12 by pivoting on an axis created by the hinges 16 on the right side. A handle device 18 may be disposed along the non-hinged side of the door 12 in order to allow a user to open and/or close the door 12 with the handle device 18 as needed. FIG. 1 also illustrates a foot pedal door opener device 20 used to open the right-handed door 12 when the pedal door opener device 20 is actuated by the user.

Figure 2:
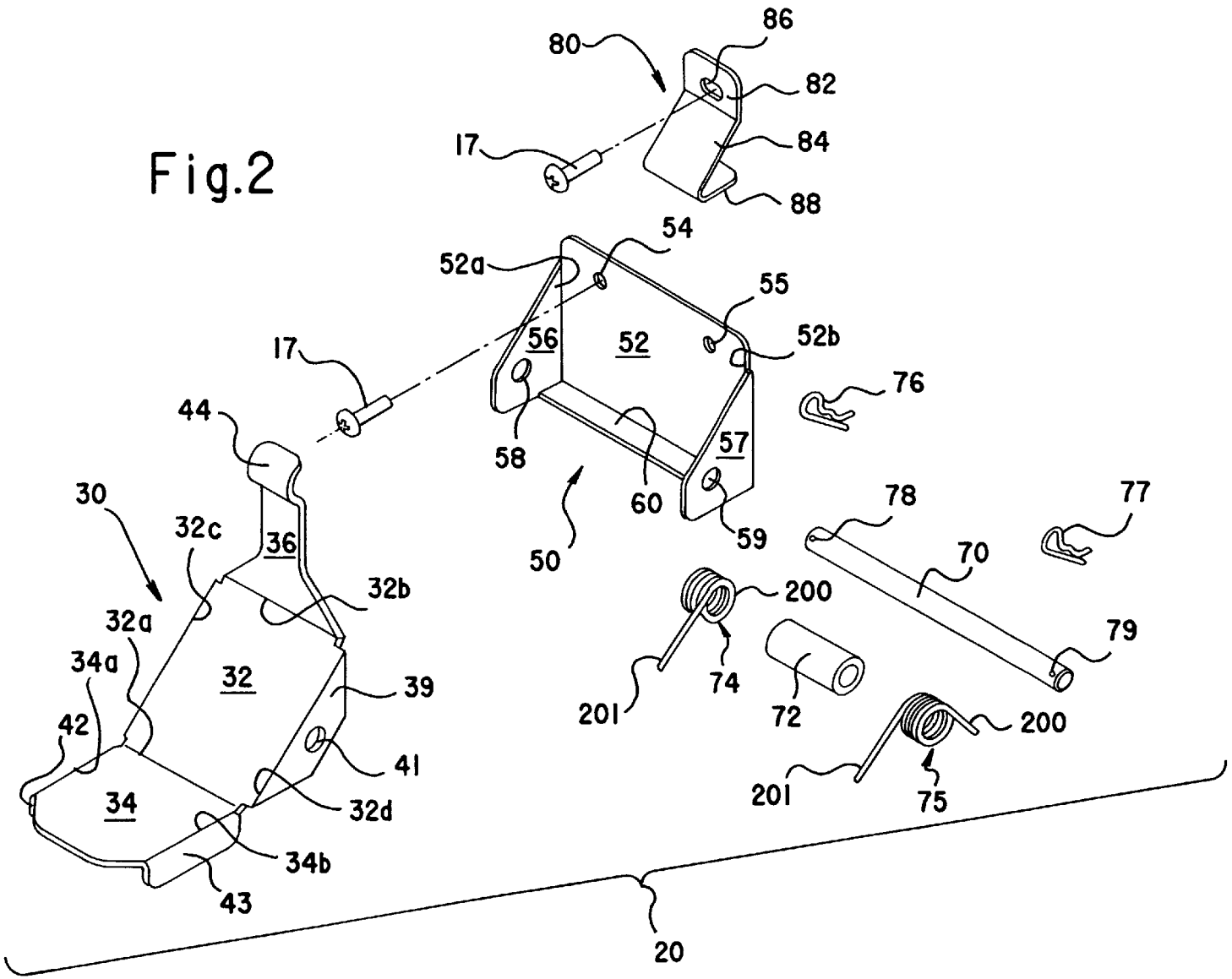
FIG. 2 is an exploded view of the foot pedal door opener device of FIG. 1.

FIG. 2 illustrates an exploded view of the pedal door opener device 20. The pedal door opener device 20 includes a pedal 30, a mounting bracket 50, and a retaining clip 80.

The pedal 30 includes an inclined portion 32, a tread portion 34, and an actuating portion 36. In the preferred embodiment, the inclined portion 32 is substantially rectangular in shape and angled relative to the door 12 of the cabinet 10. The inclined portion 32 has a bottom 32*a,* top 32*b,* and left and right sides 32*c* and 32*d.*

A left flange 38 and a right flange 39 extend downward from the left and right sides 32*c* and 32*d* of the inclined portion 32. Each flange 38 and 39 has a hole or aperture 40 and 41, respectively, such that the center of the left hole 40 is aligned with the center of the right hole 41.

Preferably, the tread portion 34 is also substantially rectangular in shape and extends horizontally away from the bottom 32*a* of the inclined portion 32 toward the user in a plane substantially parallel to the floor upon which the cabinet 10 is disposed. It should be noted that the selected shape of the tread portion 34 is critical in that the shape should be selected such that the tread portion 34 prevents a user from unintentionally activating two pedals 30 simultaneously when arranged pursuant to the second and third embodiments, which will be discussed in more detail later. Alternatively, the tread portion 34 may include a left flange 42 and a right flange 43 that extend downward from left and right sides 34*a* and 34*b,* respectively, of the tread portion 34 to provide additional strength and support to the pedal 30.

The actuating portion 36 is connected to the top 32*a* of the inclined portion 32, extends vertically away from the inclined portion 32, and is substantially parallel with the door 12 of the cabinet 10. Preferably, the actuating portion 36 is triangular in shape with a tapered end remote from the top 32*a* of the inclined portion 32 to form a curved engaging head 44. However, the shape of the actuating portion 36 is not limited to triangular and may be other shape, such as, for example, a rectangle, so long as the actuating portion 36 fits between the cabinet 10 and cabinet door 12.

The engaging head 44 is the portion of the pedal 30 which contacts an interior side of the door 12 and forces the door 12 open when the pedal door opener device 20 is activated by a user. As such, when the pedal 30 is depressed, the engaging head 44 will swing toward the user, thereby pressing against an interior point 12*a* (FIG. 5) of the door 12, resulting in the door 12 swinging open, which will be discussed in further detail below.

Preferably, the mounting bracket 50, as illustrated in FIG. 2, includes a substantially rectangular body 52, a pair of flanges 56 and 57, and a shelf 60. Alternatively, the mounting bracket 50 may include only the flanges 56 and 57 connected to each other by the shelf 60 without the bracket body 52 structure. The bracket body 52 includes at least two holes or apertures 54 and 55 located near a top of the body 52 and sized to receive a connector 17, such as, for example, a screw or the like.

Extending away from left and right sides 52*a* and 52*b* of the body 52 toward the pedal 30 are parallel left and right flanges 56 and 57, respectively. Each flange 56 and 57 has a hole or aperture 58 and 59, respectively, such that the center of the left hole 58 is aligned with center of the right hole 59. Although FIG. 2 illustrates the flanges 56 and 57 as being substantially right triangularly shaped, the shape of the flanges 56 and 57 are not limited to such and can be any shape that will permit retention of the pedal 30 therebetween.

Extending away from a bottom side of the body 52 toward the user is a shelf 60 which extends substantially parallel with the floor upon which the cabinet 10 is placed. The shelf 60 extends across a portion of a bottom surface of flanges 56 and 57 to stop the pedal 30 from rotating more than approximately 45 degrees relative to the body 52 when depressed by the user. The restricted angular movement of the pedal 30 is incorporated into the design of the device so that in the event the springs 74 and 75 fail to return the pedal 30 to its original or at rest position, the door 12 of the cabinet 10, upon closing, will not return to the cabinet face before the pedal 30 returns to its at rest position. Also, if the movement of the pedal 30 were not restricted as such, the pedal 30 could malfunction (See FIG. 5).

The distance that shelf 60 extends from body 52 is dependent upon the size and angle of the flanges 38 and 39 of the inclined portion 32 of the pedal 30. Furthermore, the shelf 60 serves to conceal leg 200 of the springs 74 and 75 from the user to eliminate the risk of the user being cut by any burrs or edges on the ends of the spring leg 200.

A cylindrical rotating member 70 is configured to pass through the holes 58 and 59 of the flanges 56 and 57 and has a length that is longer than a length of the mounting bracket 50. Near each end of the rotating member 70 is a hole or aperture 78 and 79 passing through an entire diameter of the rotating member 70. The holes 78 and 79 are located outside of the flanges 56 and 57, respectively, when the rotating member 70 is inserted into the holes 58 and 59 of the flanges 56 and 57. The rotating member 70 is also sized to receive, springs and a spacer 72 which serves to maintain a predetermined distance between the springs 74 and 75.

The springs 74 and 75 can be used to bias the foot pedal 20 to return to an original position after being actuated. The springs 74 and 75 can include, for example, first and second torsion springs 74 and 75 disposed between the left flange 38 of the inclined portion 32 of the pedal 30, the spacer 72, and the right flange 39 of the inclined portion 32 of the pedal 30, respectively.

A retaining clip 80 to maintain the pedal 30 in a desired position includes a vertical portion 82 having a protruding portion 84 extending from a lower end. The vertical portion 82 is substantially parallel with the body 52 of the mounting bracket 50 and has an oblong aperture or hole 86 therein sized to receive the connector 17. The protruding portion 84 extends away from the vertical portion 82 toward the user at an angle preferably equal to the angle of the inclined portion 32. Thus, when the retaining clip 80 is mounted to the bracket 50, the left or right flange 38 and 39 of the inclined portion 32 of the pedal 30 will contact the protruding portion 84 of the retaining clip 80 to prevent the pedal 30 from moving from its position on the rotating member 70.

The retaining clip 80 may also include an extension support 88 which extends away from a lower end of the protruding portion 84 toward the body 52 of the bracket 50. The extension support 88 is configured to help the protruding portion 84 maintain the angle the protruding portion 84 extends from the vertical portion 82.

The assembly and mounting procedure of the pedal door opener device 20 will now be discussed.

Initially, the hairpin 77 is placed through the hole 79 of the rotating member 70. Then, a first end of the rotating member 70 is passed through either hole 58,59 of the left and right flanges 56, 57 of the mounting bracket 50. Next, the first end of the rotating member 70 is passed through either hole 40, 41 of corresponding left and right flanges 38 and 39 of the pedal 30. Then, the first torsion spring 74, spacer 72, and second torsion spring 75 are placed on a portion of the rotating member 70, in the above-listed order.

Next, the first end of the rotating member 70 is passed through the remaining hole 40, 41 of the correspondingly remaining left and right flange 38 and 39 of the pedal 30. Thus, the springs 74 and 75 and spacer 72 are mounted on the rotating member 70 between the left and right flanges 38 and 39 of the inclined portion 32 of the pedal 30. Then, the first end of the rotating member 70 is passed through the remaining hole 58, 59 of the remaining left and right flange 56 and 57 of the mounting bracket 50. Next, the hairpin 76 is placed through the hole 78 of the rotating member 70 to hold the rotating member 70 in position on the mounting bracket 50, with the pedal 30 being slidably held on the rotating member 70.

At this point, the pedal 30 is positioned on the rotating member 70 between the flanges 56 and 57 of the mounting bracket 50 such that the pedal 30 is free to slide laterally along the rotating member 70 between the flanges 56 and 57. Furthermore, the pedal 30 can rotate around the rotating member 70 toward the user, i.e., away from the body 52 of the mounting bracket 50, until the flanges 38 and 39 contact the shelf 60 of the bracket 50. An angle of rotation of the pedal 30 is defined by the distance that shelf 60 extends away from the body 52 of the bracket 50 and an angle of inclination of a forward surface of the flanges 38 and 39 of the inclined portion 32 of the pedal 30.

Then, in order to make the foot pedal door opener device a right door pedal door opener device, as shown in FIG. 1, the pedal 30 is moved to the right side of the rotating member 70. Next, the mounting bracket 50 with rotating member 70 and pedal 30 mounted thereon is placed against the cabinet 10. Then, the connector 17 is passed through the left side hole 54 in the body 52 of the mounting bracket 50 into the outer surface of the cabinet 10. Next, the pedal 30 is moved to the left side of the rotating member 70, exposing the right side hole 55. Then, the oblong aperture 86 of the retaining clip 80 is aligned with the right side hole 55 of the body 52 of bracket 50. Then, connector 17 is passed through the aperture 86 and right side hole 55 into the outer surface of the cabinet 10 to complete the assembly and mounting of the device 20 onto the cabinet 10.

Figure 3:
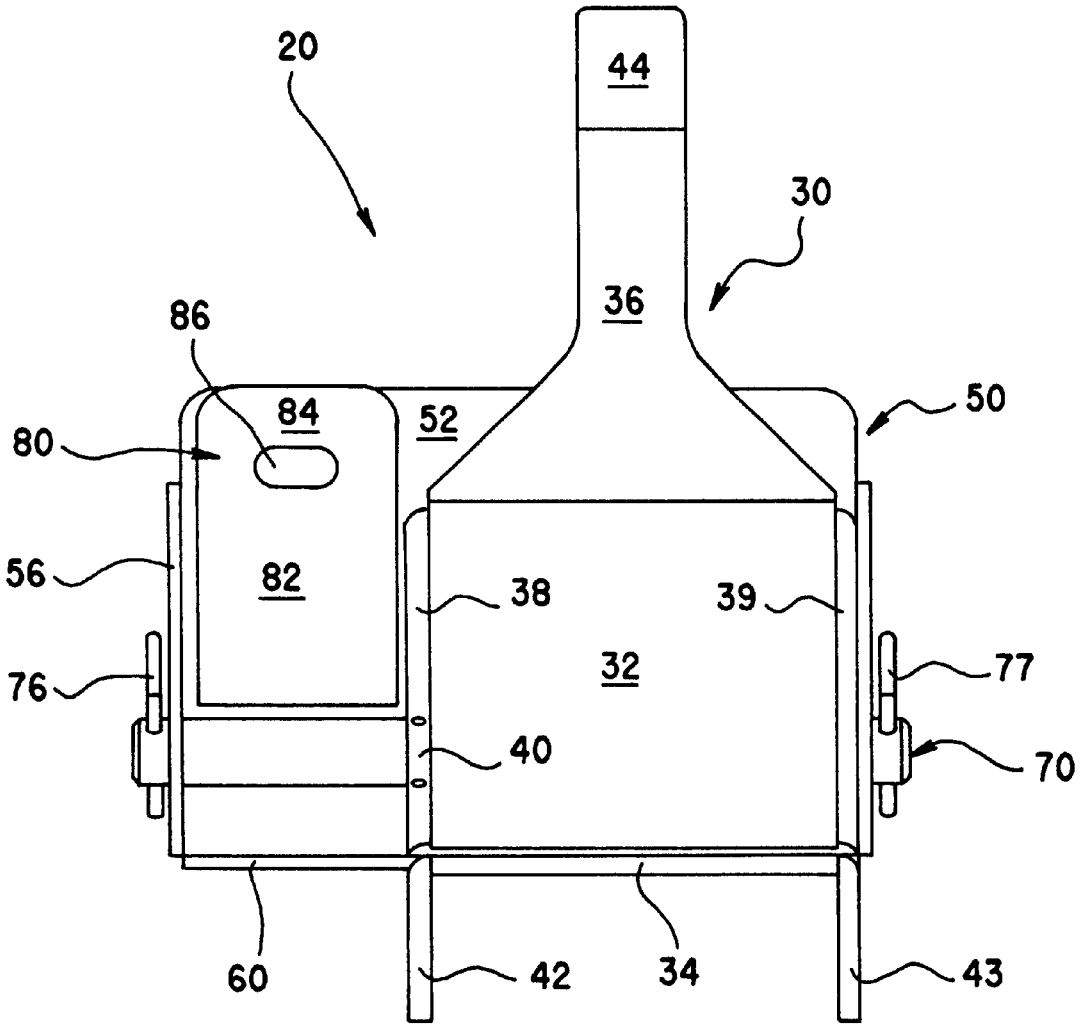
FIG. 3 is a front view of the assembled foot pedal door opener device.

It should be noted that a feature of this invention is the ability to quickly and simply assemble the device 20 to be a left door pedal door opener device, as shown in FIG. 3, or a right door pedal door opener device, as discussed above. For example, rather than first moving the pedal 30 to the right side of the rotating member 70, the pedal 30 is first moved to the left side of the rotating member 70, exposing the right side hole 55. Next, the mounting bracket 50 with rotating member 70 and pedal 30 mounted thereon is placed against the cabinet 10. Then, the connector 17 is passed through the right side hole 55 in the body 52 of the mounting bracket 50 into the outer surface of the cabinet 10. Next, the pedal 30 is moved to the right side of the rotating member 70, exposing the left side hole 54. Then, the oblong aperture 86 of the retaining clip 80 is aligned with the left side hole 54 of the body 52 of bracket 50. Then, connector 17 is passed through the aperture 86 and left side hole 54 into the outer surface of the cabinet 10 to complete the assembly and mounting of the device 20 onto the cabinet 10.

The operation of the pedal door opener device 20 will now be discussed.

Figure 4:
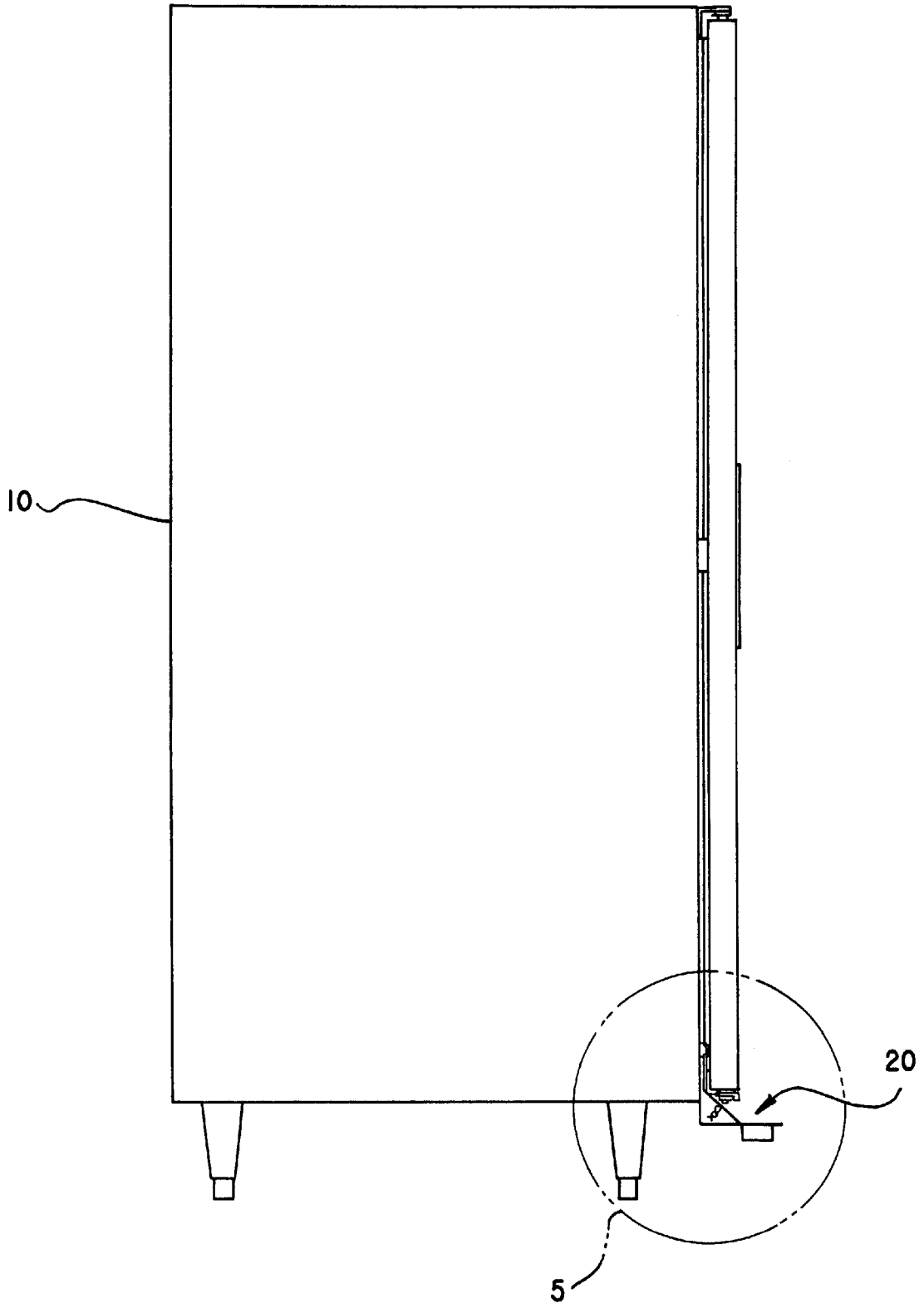
FIG. 4 a side view of the single door cabinet with the foot pedal door opener device mounted thereon.
Figure 5:
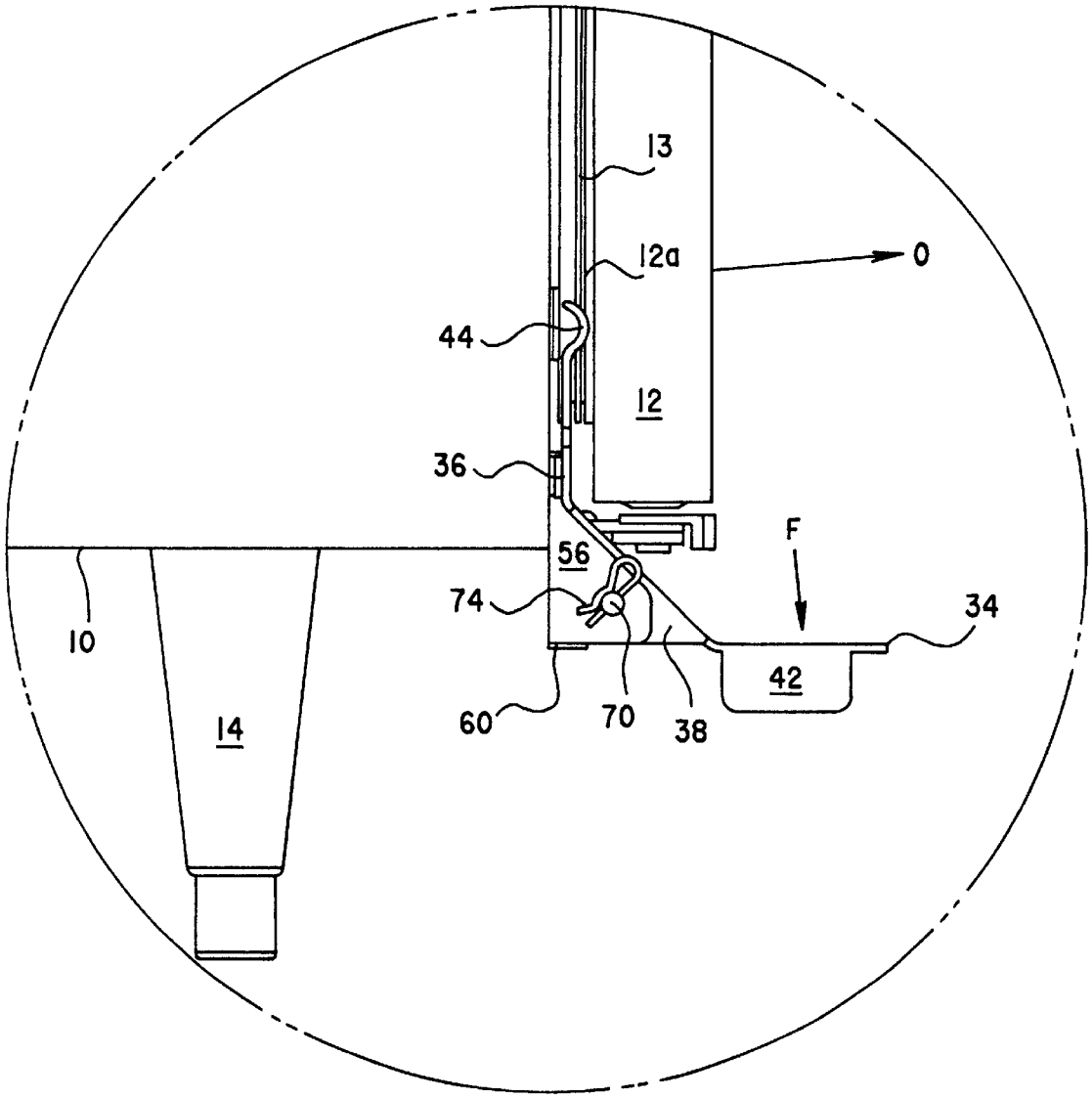
FIG. 5 is an enlarged view of the foot pedal door opener device illustrated in FIG. 4.

FIG. 4 illustrates a side view of the pedal door opener device 20 mounted to the cabinet 10. FIG. 5 is an enlarged view of the mounted foot pedal door opener device 20 of FIG. 4. When a user depresses the tread portion 34 of the pedal 30 in a direction indicated by arrow F, the pedal 30 rotates about the rotating member 70 in a clockwise direction, as indicated by the dashed line. As such, the engaging head 44 of the pedal 30 contacting an inner point 12*a* of the door 12 forces the door 12 away from the cabinet 10 in a direction indicated by the arrow O, thereby opening the cabinet door 12 so that the user may enter and/or have access to an interior of the cabinet 10.

Figure 6:
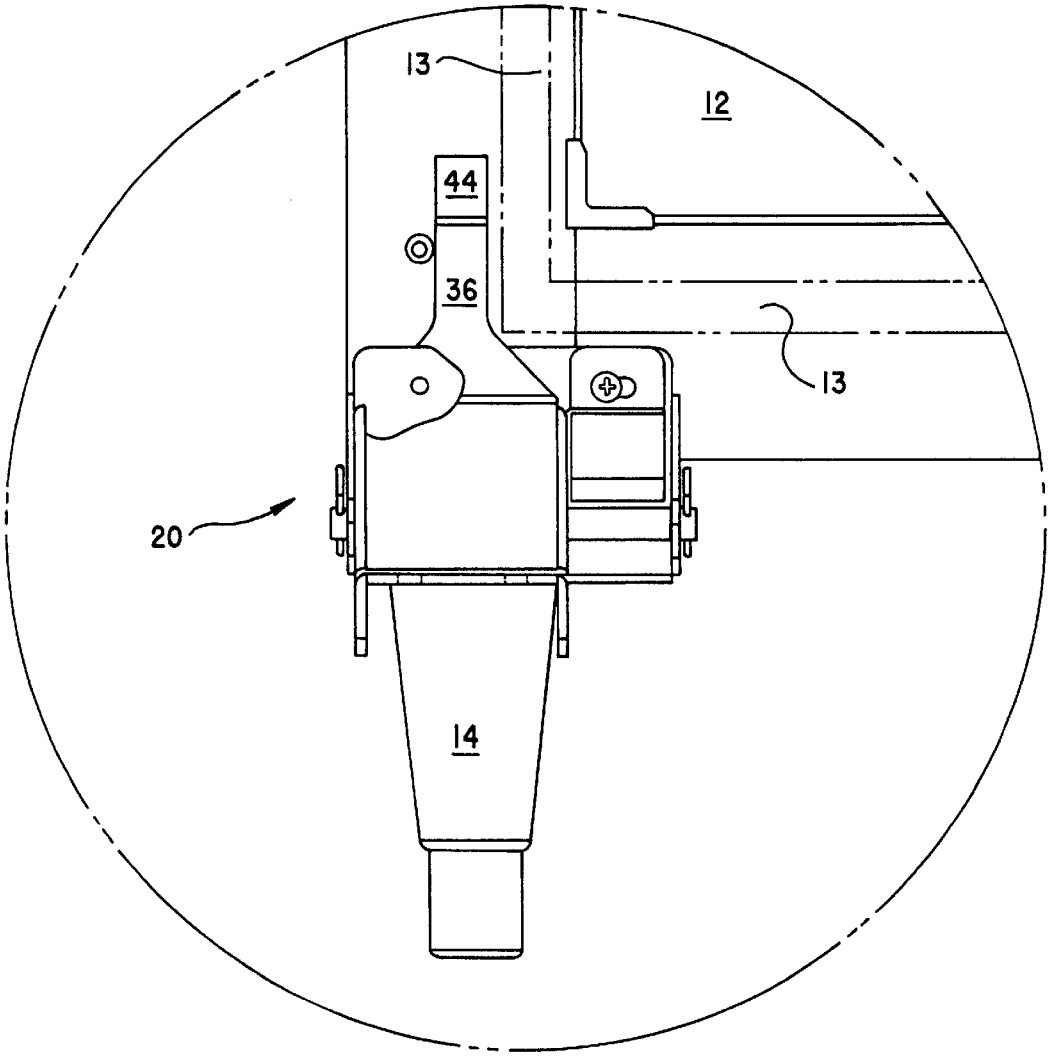
FIG. 6 is an enlarged view of the foot pedal door opener device illustrated in FIG. 1 in relation to a gasket of the cabinet.

As illustrated in FIG. 6, the foot pedal door opener device 20 is configured to have the engaging head 44 contact the inner point 12*a* of the door 12 between an outer edge of the door 12 and the gasket 13 of the door 12. Therefore, another benefit of the device 20 of this invention is that the integrity of the gasket 13 of the cabinet door 12 is not compromised when the device 20 is mounted to the cabinet 10. Accordingly, air does not leak or escape from the interior of the cabinet 10, thereby keeping any refrigerated items chilled while maintaining the operating efficiency of the cabinet 10.

Figure 7:
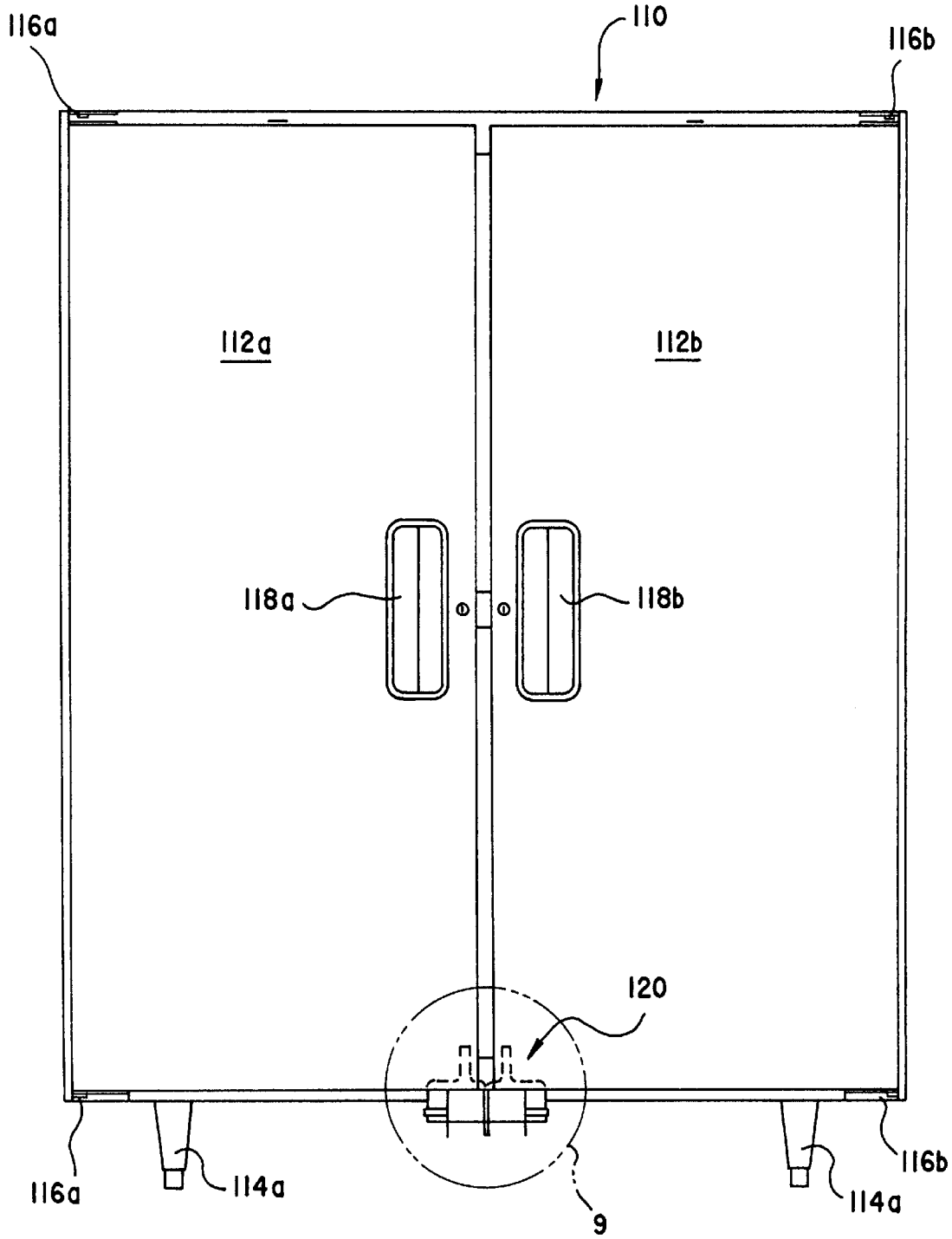
FIG. 7 is a front view of a two-door cabinet with a foot pedal door opener device for each cabinet door according to a second embodiment of the invention.

FIG. 7 illustrates a front view of another embodiment of the foot pedal door opener device 120 according to the present invention for a two-door commercial reach-in type cabinet 110 with a left-handed door 112*a* and a right-handed door 112*b*. The cabinet 110 can be supported by legs 114*a* and 114*b*, or by casters (not shown). The left-handed door 112*a* and right-handed door 112*b* are provided with hinges 116*a* and 116*b* at outer portions thereof, respectively, so that the doors 112*a* and 112*b* can swing outwardly from a center section by pivoting on an axis created by the hinges 116*a* and 116*b* on the left and right sides, respectively, when opened. Each door 112*a* and 112*b* has a handle device 118*a* and 118*b*, respectively, that is disposed along the non-hinged side of the door 112*a* and 112*b* in order to allow a user to open/or close the door 112*a* and 112*b* with the handle device 118*a* and 118*b* as needed.

Figure 8:
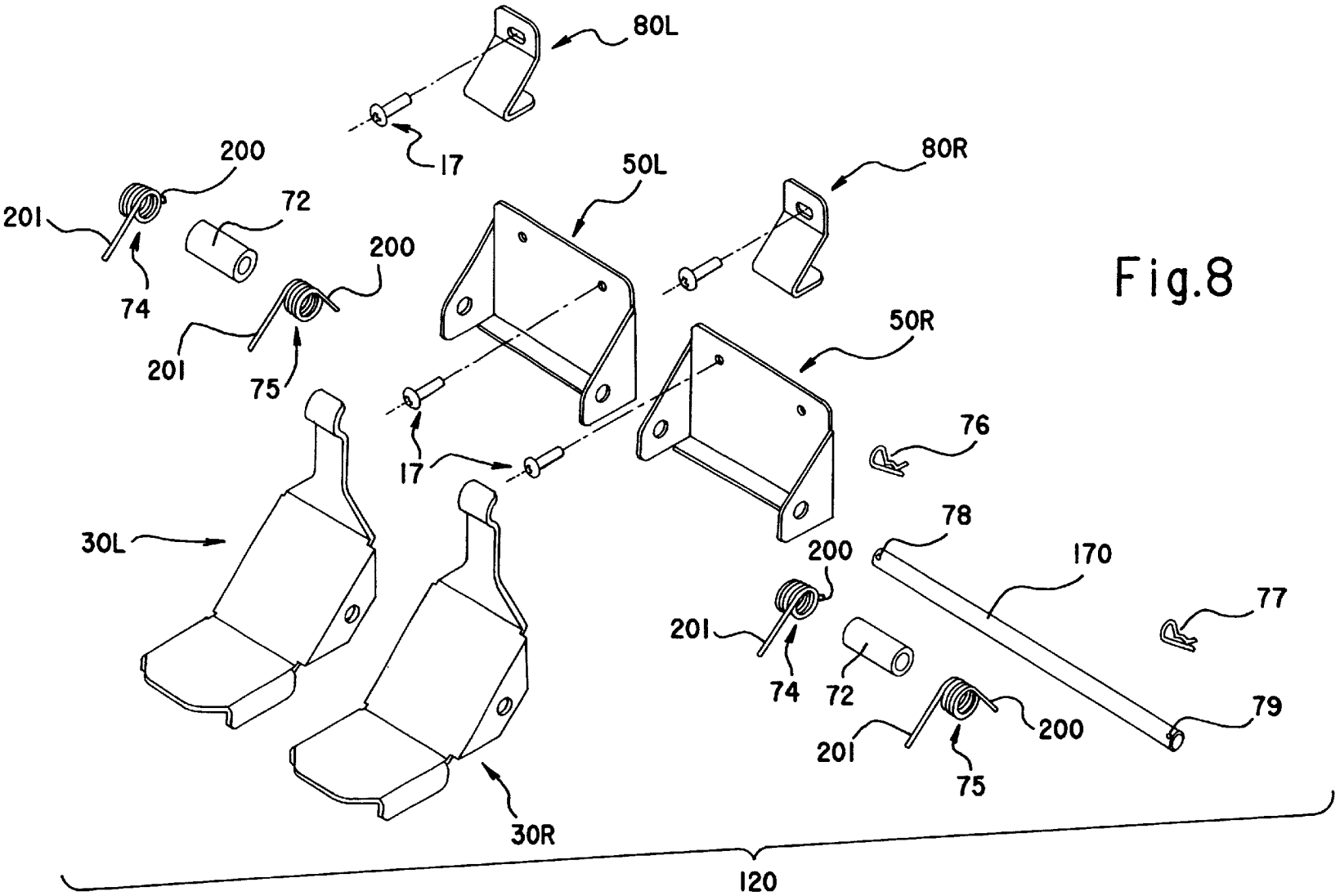
FIG. 8 is an exploded view of the foot pedal door opener device illustrated in FIG. 7.

FIG. 8 illustrates an exploded view of the left and right sided foot pedal door opener device 120. Essentially, the components of the foot pedal door opener device 120 of the second embodiment are substantially similar to the foot pedal door opener device 20 of the first embodiment illustrated in FIGS. 1–6. As such, discussion of the similar parts are omitted from here to avoid redundancy. However, the foot pedal door opener device 120 of the second embodiment is different than the door opener device 20 of the first embodiment.

For example, while the pedals 30L,30R, mounting brackets 50L,50R, and retaining clips 80L,80R are identical to those in the first embodiment, the door opener device 120 of the second embodiment is different in that there is one rotating member 170 for both pedals 30L,30R, brackets 50L,50R and retaining clips 80L,80R. In other words, the rotating member 170 is of a length that passes through both brackets 50L,50R and pedals 30L,30R, thereby holding the foot pedal door opener device 120 together as a single unit.

To assemble the door opener device 120, the hairpin 76 or 77 is passed through the hole 78 or 79 of the rotating member 170. Then, a first end of the rotating member 170 is passed through either the hole 59 of the flange 57 of the right mounting bracket 50R or the hole 58 of the flange 56 of the left mounting bracket 50L. Next, the first end of the rotating member 170 is passed through either the hole 40 of the left flange 38 of the left pedal 30L or the hole 41 of the right flange 39 of the right pedal 30R. Then, the torsion spring 75, spacer 72, and torsion spring 74 are place on a portion of the rotating member 170, in the above-listed order. If assembled from left to right, the assembly should be made by placing the torsion spring 74, spacer 72, and torsion spring 75 on a portion of the rotating member 170 in the above-listed order.

Next, the first end of the rotating member 170 is passed through the hole 41 of the right flange 39 of the left pedal 30L or the hole 40 of the left flange 38 of the right pedal 30R. Then, the first end of the rotating member 170 is passed through both the hole 56 of the flange 58 of the right mounting bracket 50R and hole 59 of the flange 57 of the left mounting bracket 50L. At this stage, the device 120 is partially assembled.

To complete assembly, the first end of the rotating member 170 is passed through either hole 41 of the right flange 39 of the left pedal 30L or hole 40 of the left flange 38 of the right pedal 30R. Then, the torsion spring 75, spacer 72, and torsion spring 74 are placed on a portion of the rotating member 170 in the above-listed order if assembled from right to left. If assembled from left to right, the assembly should be made by placing the torsion spring 74, space 72, and torsion spring 75 on a portion of the rotating member 170 in the above-listed order.

Similar to the steps above, the first end of the rotating member 170 is then passed through the hole 40 of the left flange 38 of the left pedal 30L or the hole 41 of the right flange 39 of the right pedal 30R. Following this step, the first end of the rotating member 170 is passed through either the hole 58 of the flange 56 of the right mounting bracket 50R or the hole 59 of the flange 57 of the left mounting bracket 50L. Final assembly is accomplished by passing the hairpin 76 or 77 through either hole 78 or 79 of the rotating member 170. Upon finishing this step, the rotating member 170 will be held in position on the mounting brackets 50L and 50R, with the pedal 30L and 30R being slidably held on the rotating member 170 between the flanges 56 and 57 of their respective mounting brackets 50L and 50R.

At this point, each pedal 30L and 30R is positioned on the rotating member 170 between the flanges 56 and 57 of their respective mounting bracket 50L and 50R such that each pedal 30L and 30R is free to slide laterally along the rotating member 170 between the flanges 56 and 57. Furthermore, each pedal 30L and 30R can rotate around the rotating member 170 toward the user, i.e., away from the body 52 of the mounting bracket 50L and 50R, until the flanges 38 and 39 contact the shelf 60 of the bracket 50L and 50R. An angle of rotation of each pedal 30L and 30R is defined by the distance that shelf 60 extends away from the body 52 of the bracket 50L and 50R and an angle of inclination of a forward surface of the flanges 38 and 39 of the inclined portion 32 of each pedal 30L and 30R.

Next, the mounting brackets 50L and 50R with rotating member 170 and pedal 30L and 30R mounted thereon are placed against the cabinet 110. Then, the connector 17 is passed through the right side hole 55 in the body 52 of the mounting bracket 50L into the outer surface of the cabinet 110 and another connector is passed through the left side hole 54 of the mounting bracket 50R. Next, the pedal 30L is moved to the right side of the mounting bracket 50L, exposing the left side hole 54, and the pedal 30R is moved to the left side of the mounting bracket 50R, exposing the right side hole 55. Then, the oblong aperture 86 of the retaining clip 80L is aligned with the left side hole 54 of the body 52 of mounting bracket 50L and the oblong aperture 86 of the retaining clip 80R is aligned with the right side hole 55 of the body 52 of the mounting bracket 50R.

Finally, a connector 17 is passed through each of the aperture 86 and left side hole 54 of the mounting bracket 50L and the aperture 86 and right side hole 55 of the mounting bracket 50R into the outer surface of the cabinet 110 to complete the assembly and mounting of the device 120 onto the cabinet 110. It should be noted that the door opener device 120 is mounted in the center of the front outer surface of the cabinet 110 between the left and right cabinet doors 112*a* and 112*b*, respectively.

In operation, the left and right pedals 30L, 30R open their respective doors 112*a* and 112*b* in a similar manner as does the pedal 30 of the door opener device 20 of the first embodiment. Thus, when a user depresses either pedal 30L,30R, the corresponding engaging head 44 of the depressed pedal will rotate about the rotating member 170, thereby forcing the corresponding door 112*a* or 112*b* to open.

Figure 9:
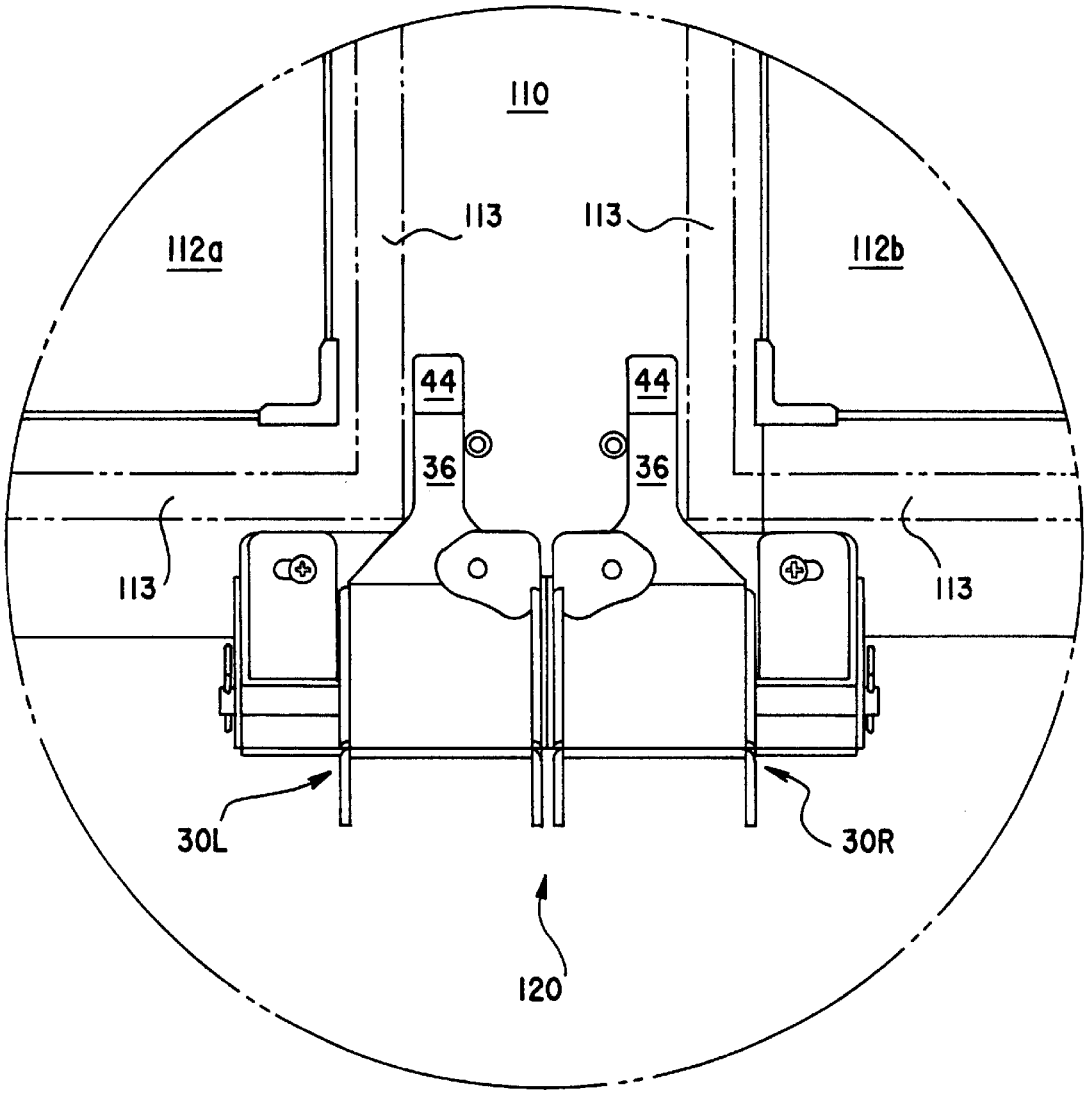
FIG. 9 is an enlarged view of the foot pedal door opener device illustrated in FIG. 7 in relation to a gasket of the cabinet.

FIG. 9 illustrates the positioning of the engaging head 44 of the door opener device 120 in relation to the gasket 113 of the cabinet 110. As can be seen, the engaging heads 44 of both the left and right pedals 30L,30R of the opening device 120 do not contact or pierce the gasket 113 similarly to the first embodiment illustrated in FIG. 6. As such, the integrity of the gasket 113 is not compromised and the cabinet 110 is able to maintain its efficiency and keep the items therein chilled as desired.

Figure 10:
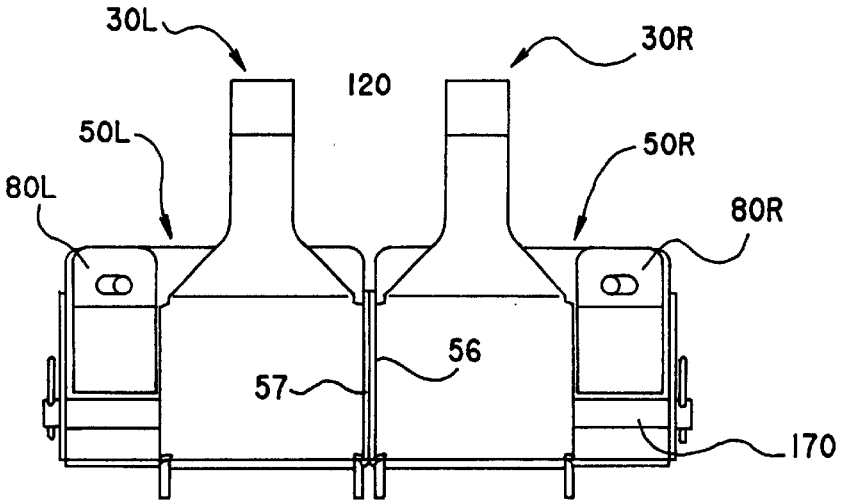
FIG. 10 is a front view of the foot pedal door opener device illustrated in FIG. 7.

FIG. 10 illustrates a front view of the assembled foot pedal door opener device 120 with the retaining clips 80L,80R secured to their respective mounting brackets 50L,50R. The left pedal 30L is prevented from sliding laterally along the rotating member 170 by the retaining clip 80L and the right flange 57 of the left mounting bracket 50L. Likewise, the right pedal 30R is prevented from sliding along the rotating member 170 by the retaining clip 80R and the left flange 56 of the right mounting bracket 50R.

Figure 11:
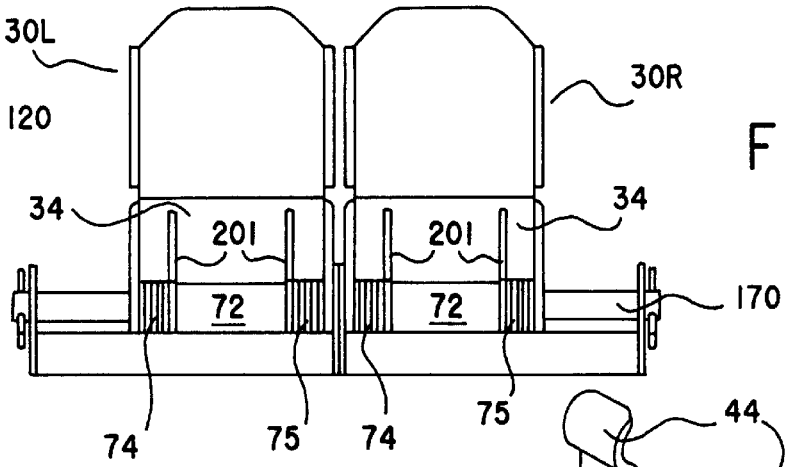
FIG. 11 is a bottom view of the foot pedal door opener device illustrated in FIG. 7.

FIG. 11 illustrates a bottom view of the pedal door opener device 120 shown in FIGS. 7–10. The spacers 72 and first and second torsion springs 74,75 of both pedals 30L,30R are mounted onto the rotating member 170. Each torsion spring 74,75 has two legs 200 and 201 extending away from the springs.

One arm 200 is positioned against the body 52 of its respective mounting bracket 50, 50L, or 50R while the remaining arm 201 is positioned against the underside of the inclined portion 32 of the pedal 30, 30L, or 30R. Therefore, when the user depresses the tread portion 34, the arm 200 against the body 52 remains fixed thereon and the second arm 201 rotates according to the amount the pedal 30, 30L, or 30R rotates around the rotating member 70, 170. Then, the body of the torsion spring 74,75 biases the arm 201 and forces the pedal 30, 30L, or 30R to rotate back around the rotating member 70,170 in a direction opposite to when the user depressed the tread portion 34. The pedal 30, 30L, 30R then returns to its original position.

Figure 12:
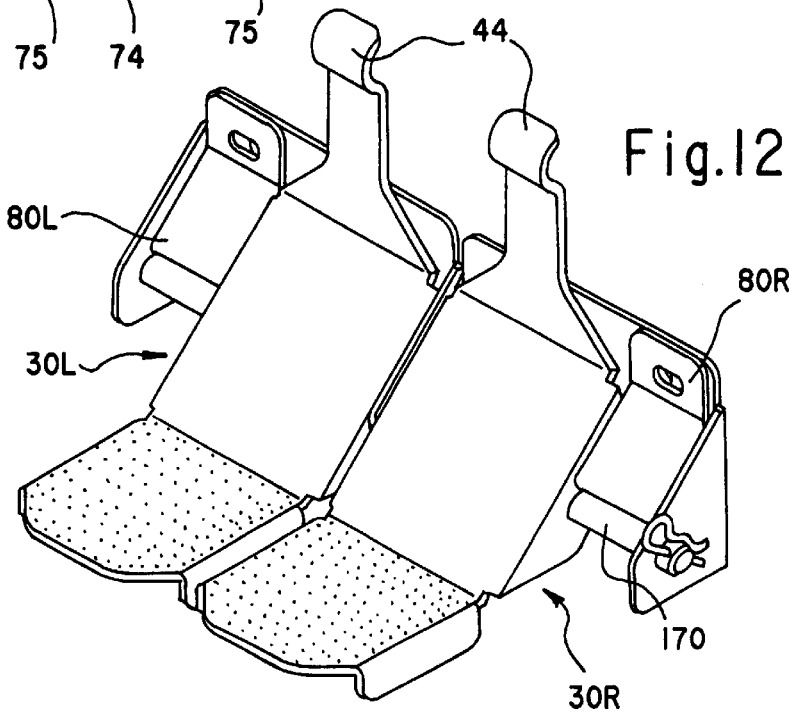
FIG. 12 is an isometric view of the foot pedal door opener device illustrated in FIG. 7.

FIG. 12 is an isometric view of the assembled foot pedal door opener device 120 and illustrates how the retaining clips 80L,80R prevent the left and right foot pedals 30L,30R from moving laterally along the rotating member 170.

Figure 13:
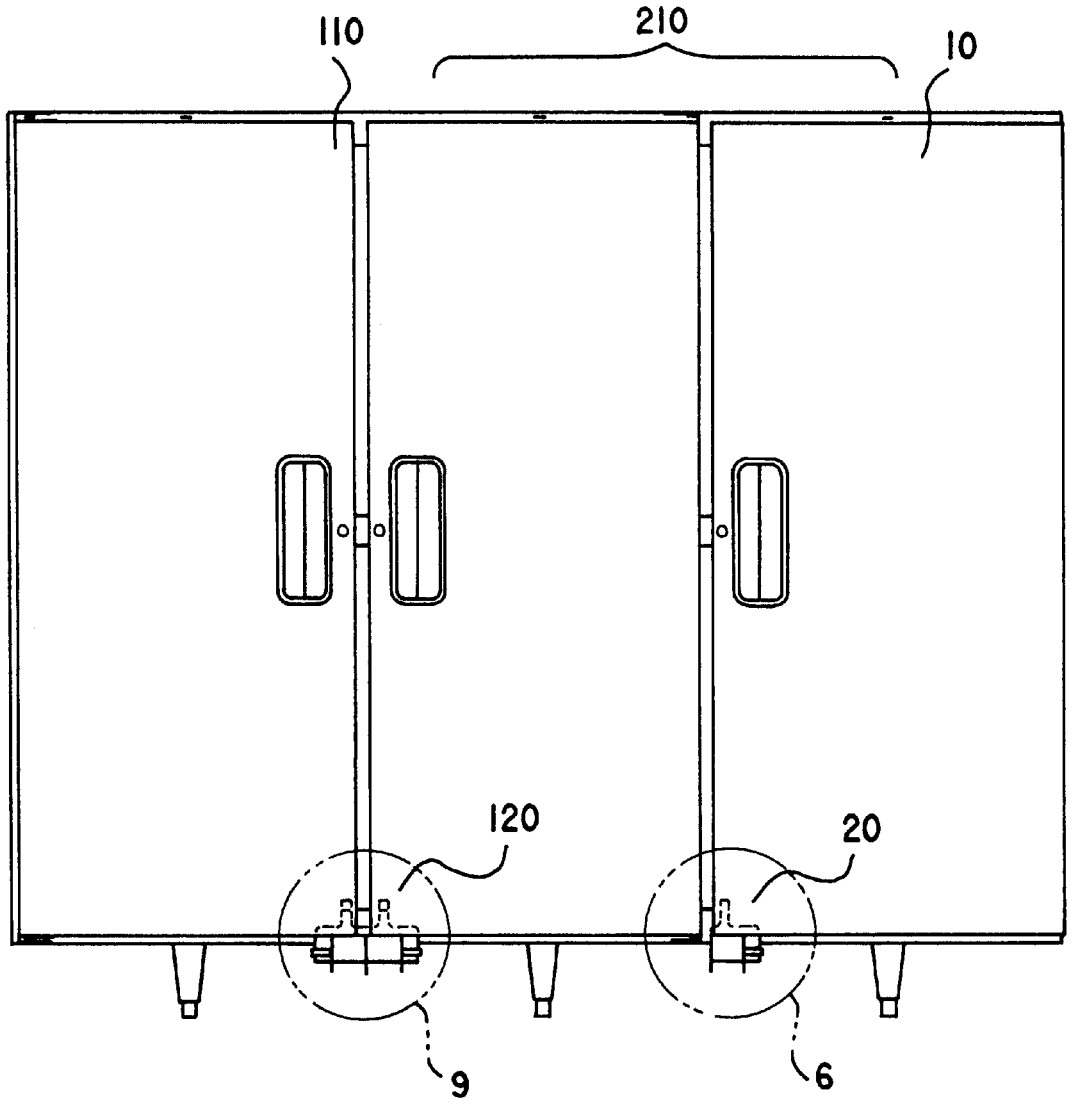
FIG. 13 is a front view illustrating a third embodiment of the invention which incorporates the foot pedal door opener devices from the first and second embodiments into a three-door cabinet.

FIG. 13 shows a third embodiment of the present invention in which the foot pedal door opener device 20 of the first embodiment and the foot pedal door opener device 120 of the second embodiment are both used on a cabinet 210 with more than two doors, e.g., a three door cabinet. It can be seen that the foot pedal door opener device 20 of the first embodiment is used with the single or lone doored cabinet 10 while the pedal door opening 120 device of the second embodiment is used with the dual door cabinet 110.

While there has been illustrated and described what has been considered to be preferred embodiments of the present invention, it would be understood by those skilled in arts the various changes and modifications may be made, and equivalents may be substituted for elements thereof without departing from the true scope of the invention.

For example, although the inclined and tread portions are described above as being rectangular in shape and the engaging head as curved, it should be noted herein that the described shapes are merely illustrative and not intended to limit the scope of the invention. Also, the dimensions of the described portions illustrated in the drawing figures are merely representative. As such, the shapes of the inclined, tread, and actuating portions of the pedals can be any other known geometric shape, such as, for example, circular or even shaped like a foot or shoe of the user that helps in actuating the pedal. Furthermore, although the tread portion is described and illustrated herein as being substantially parallel to the floor upon which the cabinet is disposed, it should be noted that the scope of the invention is intended to cover all angles that will be receptive toward receiving the bottom portion of a foot or shoe worn by the user to facilitate depression of the pedal.

In the illustrated embodiments, the foot pedals are disposed on a mounting plate, which is secured to a bottom portion of the cabinet. Alternatively, the pedals and rotating member could be secured directly to the cabinet by attaching the flanges of the mounting bracket and retaining clip directly to the cabinet, such as, for example, by welding or other well known methods to hold the rotating member and pedal in place.

Furthermore, rather than having two mounting brackets for the pedal door opener device of the second embodiment, it is within the scope of this invention to have a single mounting bracket capable of holding both the right and left pedals. The unitary mounting bracket will have a left flange and a right flange on each end, but would not have any flanges between the left and right pedals. Rather, the pedals would be allowed to abut each other. Thus, each pedal would be prevented from sliding laterally along the rotating member by a respective retaining clip on one side of the pedal and the other pedal rather than a retaining clip and flange, as discussed above in relation to the preferred embodiments.

In addition, many modifications may be made to adopt the particular situation or material to the teachings of the inventory without departing from the scope thereof. Therefore, it is contended that this invention not be limited to the particular embodiments disclosed herein, but includes all embodiments within the spirit and scope of the disclosure.

I claim:

1. A foot pedal door opener device used in combination with a commercial cabinet having a gasket, an outer surface, an outer edge, and a door with an interior edge comprising:

a cylindrical rotating member;

a mounting bracket that receives said rotating member and is mounted to the outer surface of the cabinet; and a pedal that opens the door of the cabinet, said pedal being rotatably attached to said rotating member, said pedal having an engaging head that contacts the interior edge of the door of the cabinet at a position located between the gasket of the cabinet and the outer edge of the cabinet, wherein said engaging head opens the door of the cabinet when said pedal is engaged by a user, wherein said mounting bracket further comprises:

a bracket body having a top substantially parallel to a bottom, said bottom being substantially parallel to the floor upon which the cabinet is located, and a left and right side;

a left flange extending from said left side of said bracket body and a right flange extending from said right side of said bracket body, each of said left and right flanges defines an aperture configured to receive said rotating member and extends away from said bracket body and cabinet; and a shelf extending away from said bottom of said bracket body substantially horizontal to the floor upon which the cabinet is located, said shelf extending partially across a bottom of said left and right flanges of said mounting bracket.

2. The foot pedal door opener device according to claim 1, wherein said pedal comprises:

an inclined portion having a top edge and a bottom edge;

a tread portion that extends substantially horizontal relative to the floor upon which the cabinet is located from said bottom edge of said inclined portion; and an actuating portion extending substantially vertical relative to the door of the cabinet from said top edge of said inclined portion, said actuating portion having said engaging head at a distal end of said actuating portion remote from said top edge of said inclined portion.

3. The foot pedal door opener device according to claim 2, wherein said inclined portion includes a left edge and a right edge, each of said left and right edges having a flange extending therefrom toward the cabinet, each flange defining an aperture configured to receive said rotating member such that said pedal rotates about said rotating member in a plain transverse to a longitudinal axis of said rotating member.

4. The foot pedal door opener device according to claim 3, further comprising:

at least one spring to bias said pedal in the direction transverse to said longitudinal axis of said rotating member, said at least one spring being positioned on said rotating member between said left and right flanges of said inclined portion of said pedal; and a spacer that maintains a position of said at least one spring on said rotating member.

5. The foot pedal door opener device according to claim 1, further comprising:

a retaining clip that prevents said pedal from sliding laterally along said rotating member between said left and right flanges of said mounting bracket in a direction parallel to a longitudinal axis of said rotating member.

6. The foot pedal door opener device according to claim 5, wherein said retaining clip comprises:

a vertical portion defining an oblong aperture therein, said vertical portion having a top edge and a bottom edge; and a protruding portion extending from said bottom edge of said vertical portion at an angle oblique relative to said vertical portion away from said cabinet, said oblong aperture configured to receive a connector to mount said retaining clip to said mounting bracket and said mounting bracket to the outer surface of the cabinet.

7. The foot pedal door opener device according to claim 1, wherein said bracket body defines at least two apertures proximate said top edge of said bracket body, said apertures configured to receive a connector to mount said bracket body to the cabinet.

8. The foot pedal door opener device according to claim 7, further comprising a retaining clip to prevent said pedal from sliding laterally along said rotating member between said left and right flanges of said mounting means in a direction parallel to said longitudinal axis of said rotating member.

9. The foot pedal door opener device according to claim 8, wherein said retaining clip comprises:

a vertical portion defining an oblong aperture therein, said vertical portion having a top edge and a bottom edge; and a protruding portion extending from said bottom edge of said vertical portion at an angle oblique relative to said vertical portion away from said cabinet, said oblong aperture configured to receive the connector to mount said retaining clip to said mounting bracket and said mounting bracket to the outer surface of the cabinet.

10. A foot pedal door opener device used in combination with a commercial cabinet having a gasket, an outer surface, an outer edge, and left and right doors, comprising;

a cylindrical rotating member;

a mounting bracket that receives said rotating member and is mounted to the outer surface of the cabinet between the left and right doors, said mounting bracket having an outer left flange extending from a left side of said mounting bracket and an outer right flange extending from a right side of said mounting bracket; and a first pedal that opens the left door of the cabinet and a second pedal that opens the right door of the cabinet; each pedal being rotatably attached to said rotating member, each pedal having an engaging head that contacts an interior of the respective door of the cabinet at a position located between the gasket of the cabinet and the outer edge of the cabinet, the first and second pedals being mounted between the outer left and right flanges of said mounting bracket, wherein said engaging head of said first pedal opens said left door when said first pedal is engaged by a user and said second pedal opens said right door when said second pedal is engaged by the user.

11. The foot pedal door opener device according to claim 10, wherein said mounting bracket further comprises:

first and second mounting brackets, said first mounting bracket has first and second flanges, said first flange of said first mounting bracket is said outer left flange and said second flange of said first mounting bracket is an inner left flange located between said outer left flange and said right flange, and said second mounting bracket has first and second flanges, said first flange of second mounting bracket is said outer right flange and said second flange of said second mounting bracket is an inner right flange, said inner right flange being located between said inner left flange of said first mounting bracket and said outer right flange, each of said inner and outer left and right flanges having an opening configured to receive said rotating member therein; and a shelf connecting said inner and outer left and right flanges, said shelf extending partially across a bottom of said flanges.

12. The foot pedal door opener device according to claim 10, wherein said mounting bracket further comprises:

a bracket body having a top substantially parallel to a bottom, said bottom being substantially parallel to the floor upon which the cabinet is located; and a shelf extending away from said bottom of said bracket body substantially horizontal to the floor upon which the cabinet is located, said shelf extending partially across a bottom of said outer left and right flanges of said bracket.

13. The foot pedal door opener device according to claim 11, or 12, wherein each of said first and second pedals comprise:

an inclined portion having a top edge and a bottom edge;

a tread portion that extends substantially horizontal relative to the floor upon which the cabinet is located from said bottom edge of said inclined portion; and an actuating portion extending substantially vertical relative to the first and second doors of the cabinet from said top edge of said inclined portion, said actuating portion having said engaging head at a distal end of said actuating portion of remote from said top edge of said incline portion.

14. The foot pedal door opener device according to claim 13, wherein said inclined portion includes a left edge and a right edge, each of said left and right edges having a flange extending therefrom toward the cabinet, each flange defining an aperture configured to receive said rotating member such that either one of said pedals rotates about said rotating member in a plain transverse to a longitudinal axis of said rotating member.

15. The foot pedal door opener device according to claim 14, wherein each of said first and second pedals comprise:

a least one spring to bias said pedal in the direction transverse to said longitudinal axis of said rotating member, said at least one spring being positioned on said rotating member between said left and right flanges of said inclined portion of said pedal; and a spacer that maintains a position of said at least one spring on said rotating member.

16. The foot pedal door opener device according to claim 11 or 12, further comprises:

a first retaining clip that prevents said first pedal from sliding laterally along said rotating member in a direction parallel to a longitudinal axis of said rotating member; and a second retaining clip that prevents said second pedal from sliding laterally along said rotating member in said direction parallel to said longitudinal axis of said rotating member, wherein each of first and second retaining clips includes a vertical portion defining an oblong aperture therein, said vertical portion having a top edge and a bottom edge, and a protruding portion extending from said bottom edge of said vertical portion at an angle oblique relative to said vertical portion away from said cabinet, said oblong aperture of each retaining clip configured to receive a connector to mount said retaining clip to said mounting bracket and said mounting bracket to the outer surface of the cabinet.

17. The foot pedal door opener device according to claim 12, wherein said bracket body defines at least two apertures proximate said top edge of said bracket body, said aperture configure to receive a connector to mount said mounting bracket to the cabinet.

18. A method of mounting a foot pedal door opener device to a commercial cabinet having a gasket, an outer surface, an outer edge, and a door with an interior edge, the device having a cylindrical rotating member, a mounting bracket having at least one pair of flanges, each flange defining an aperture configured to receive the rotating member, and at least one pedal having a pair of flanges extending toward the mounting bracket so the at least one pedal can be rotatably mounted to the rotating member, each of the flanges of the at least one pedal defining an aperture configured to receive the rotating member, the at least one pedal having an engaging head that contacts the interior edge of the door and opens the door when the pedal is engaged by a user, the method comprising the steps of:

passing the rotating member through one of the apertures of the flanges of the mounting bracket;

passing the rotating member through one of the apertures of the flanges of the pedal;

placing a first torsion spring, a spacer and a second torsion spring on a portion of the rotating member;

passing the rotating member through the other aperture of the other flange of the pedal;

passing the rotating member through the other aperture of the other flange of the mounting bracket;

locking both ends of the rotating member to the mounting bracket so that the at least one pedal is rotatably mounted to the rotating member;

attaching at least one retaining clip to the mounting bracket to prevent the at least one pedal from sliding laterally along the rotating member between the flanges of the mounting bracket in a direction parallel to a longitudinal axis of the rotating member; and mounting the mounting bracket to the outer surface of the cabinet such that the engaging head of the at least one pedal is positioned between the gasket and outer edge of the cabinet.

* * * * *